US005394857A

United States Patent [19]

Yamakawa

[11] Patent Number: 5,394,857

[45] Date of Patent: Mar. 7, 1995

[54] FUEL CONTROL SYSTEM FOR AN ENGINE AND THE METHOD THEREOF

[75] Inventor: Tadashi Yamakawa, Tokyo, Japan

[73] Assignee: Fuji Jukogyo Kabushiki Kaisha, Tokyo, Japan

[21] Appl. No.: 40,908

[22] Filed: Mar. 31, 1993

[30] Foreign Application Priority Data

Apr. 16, 1992 [JP] Japan ..... 4-096483

[51] Int. Cl.[6] ..... F02D 41/06

[52] U.S. Cl. ..... 13/686; 123/491

[58] Field of Search ..... 123/491, 486, 179.16, 123/685, 686

[56] References Cited

U.S. PATENT DOCUMENTS 4,594,986 6/1986 Shimoda et al. ..... 123/491
4,723,523 2/1988 Kataoka et al. ..... 123/491
5,220,895 6/1993 Curran et al. ..... 123/491

FOREIGN PATENT DOCUMENTS 117134 5/1988 Japan ..... 123/491

*Primary Examiner*—Tony M. Argenbright
*Attorney, Agent, or Firm*—Beveridge, DeGrandi, Weilacher & Young

[57] ABSTRACT

Re-starting an engine becomes easier by decreasing fuel amount to inject into the cylinder in accordance with the temperature of the engine and the time while the engine stops. The decreasing amount of the fuel is determined in dependency on whether the shut-off relay is ON or OFF, whether the stopping time range is within the predetermined value, or whether the coolant temperature is below the set value or not. The coefficient of the basic fuel injection amount is corrected by referring to the standard value stored in maps. Therefore, there is no occurrence of over-rich of the air-fuel ratio and malfunction of the spark plug, so that the engine can be smoothly restarted in any operating condition.

2 Claims, 15 Drawing Sheets

FUEL CONTROL SYSTEM FOR AN ENGINE AND THE METHOD THEREOF

BACKGROUND OF THE INVENTION

The present invention relates to a system for decreasing the amount of fuel injection at and/or immediately after an engine start according to the state of an engine at which the engine is stopped preceding the present engine start, whereby preventing a spark plug malfunction by excessively injected fuel.

It is known that a required amount fuel injection at an engine start is affected by external circumstances such as ambient air temperature and fuel temperature.

In a conventional engine a required amount of fuel injection at an engine start is commonly determined only by coolant temperature, that is to say, at a cold start of an engine when the coolant temperature is low, the amount of fuel injection at an engine start is increased because the fuel stuck to an inner wall of the intake manifold or other portions of the intake system is hard to vaporize.

On the other hand, at a hot start where the coolant temperature is relatively high, the amount of fuel injection at an engine start is determined in a decreased value because vaporization of fuel becomes high in the intake system.

In this type of control system for a conventional engine, once an ignition key switch is turned off, the data memorized in a RAM (RANDOM ACCESS MEMORY) are erased, so that the amount of fuel injection at a re-starting of engine has to be reestablished according to the coolant temperature at the re-starting.

Therefore, for example, in such a case where frequent cold starts are conducted with a state of incomplete warming up, air-fuel mixture of an engine becomes ever-rich because of excessive fuel and thus a fouling is caused at the spark plugs. Once the fouling is caused, it becomes very difficult to re-start the engine.

Japanese patent application laid open No. 1989-8330 discloses a technology to determine a start increment by reading the data stored in a ROM(READ ONLY MEMORY) for residual fuel amounts sticking on an inner wall of the intake manifold or the intake ports according to the engine operating condition immediately before an engine stall occurrence, then correcting these fuel amounts data by a re-start correction coefficient which is determined on a map indicating a relationship between the coolant temperature and the time from an engine stall occurrence to a next cranking start and then subtracting this correction coefficient from the fuel injection amount at the engine start which is calculated according to the engine operating conditions such as coolant temperature and cranking revolution numbers.

According to this prior art, the amount of fuel sticking on an inner wall of intake manifold is determined based on the engine operating conditions immediately before an engine stall occurrence.

However, in this prior art, once the ignition key switch is turned off after an engine stall occurrence, it is very difficult to re-start the engine because the data concerning the sticking fuel amount and the time from engine stall to cranking start are erased from the RAM and an appropriate fuel amount at an engine start is no longer provided. Further in this system, in order to obtain a good re-starting performance, a timer must be continued to be operated after an ignition key switch is turned off, so that electrical power is consumed so much.

SUMMARY OF THE INVENTION

It is an object of the present invention to provide a fuel injection amount control system for preventing the spark plugs from fouling even when frequent re-starts are applied to an engine, whereby a good startability and a smooth operation of an engine are obtained.

The fuel injection control system according to the present invention comprises: judging means for judging whether or not a cranking is started within a predetermined elapsed time from the precedent engine stop; determining means for determining initial values for start basic fuel injection amount and after-start increment coefficient according to predetermined data when a cranking is started within a predetermined time; discriminating means for determining initial values for start basic fuel injection amount and after-start increment coefficient when a cranking is started after a predetermined elapsed time; selecting means for choosing appropriate maps according to the difference between a coolant temperature at the precedent engine stop and one at the present engine start; retrieving means for reading the maps against coolant temperature, deciding means for determining a start fuel injection amount by correcting the above mentioned initial value for basic fuel injection amount using miscellaneous start correction coefficients during engine cranking; and correcting means for determining a fuel injection amount by correcting the fuel injection amount decided based on the engine operating conditions with the increment coefficient after the engine start.

Therefore, the present invention provides a good and smooths engine starting performance by means of supplying an engine with an appropriate amount of fuel corresponding to the state of the precedent engine stop, the elapsed time since the precedent engine stop and the present state of an engine even under such a stringent starting condition as an engine must be restarted after a very short period of operation of engine.

DETAILED DESCRIPTION OF PREFERRED EMBODIMENTS

Figure 14:
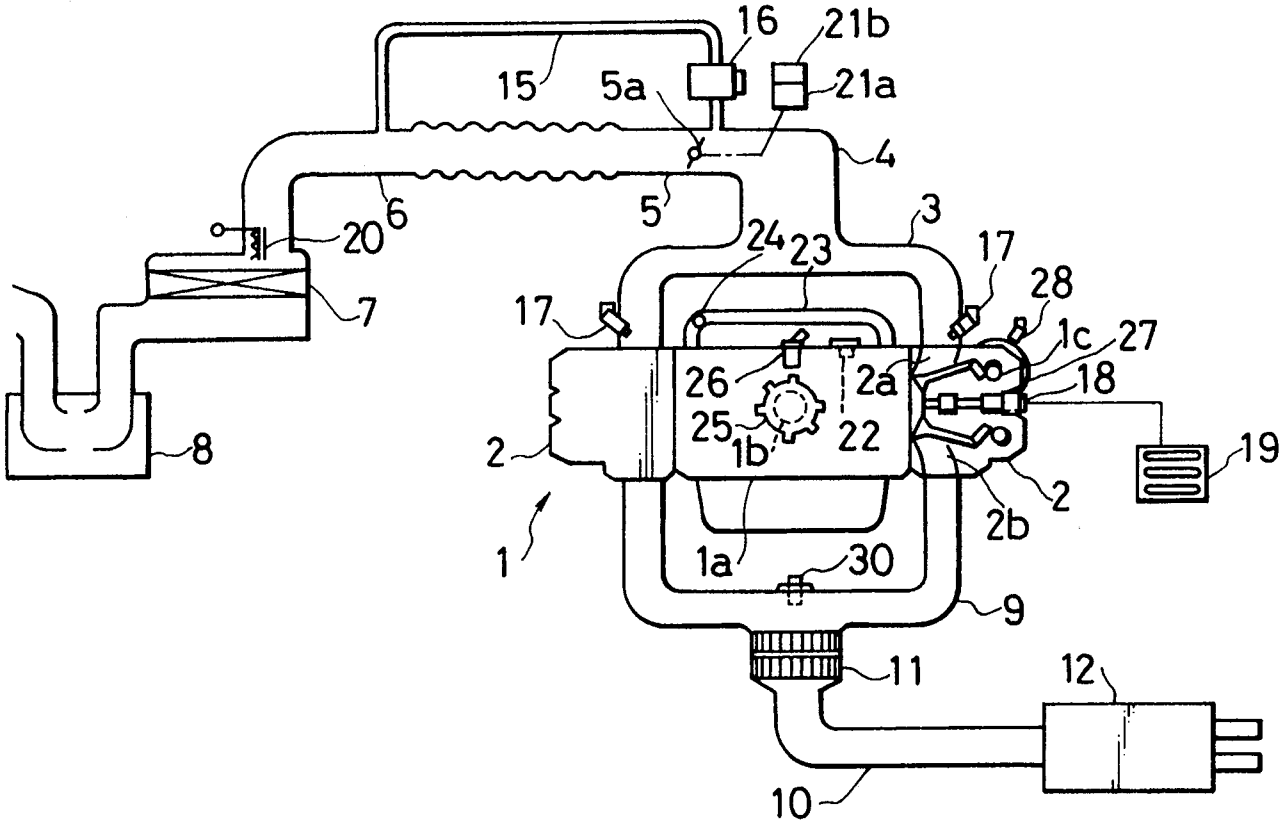
FIG. 14 is a schematic view of a system according to the present invention.

Referring to FIG. 14, a horizontally opposed four cylinder engine 1 has an intake port 2*a* in a cylinder head An intake manifold 3 is mounted on the cylinder head 2 and communicates with the intake port 2*a*. *At the upstream of the intake manifold 3, a throttle passage 5 is communicated through an air chamber 4.*

An air cleaner 7 is installed at the upstream of the throttle passage 5 through an induction conduit 6 and the air cleaner 7 is communicated with an air intake chamber 8 from which the air is introduced.

An exhaust pipe 10 is communicated with an exhaust port 2*b* through an exhaust manifold 9 being equipped with a catalytic converter 11 at the downstream end thereof, and is connected with a muffler 12.

In the throttle passage 5 a throttle valve 5*a* is provided and an idle speed control valve (ISCV) 16 is installed in a bypass passage 15 bypassing between the upstream side and the downstream side of the throttle valve 5*a*.

A fuel injector 17 for each cylinder is equipped with the intake manifold 3 at the right upstream side of the intake port 2*a* and a spark plug 18 per each cylinder is provided with its tip protruding into a combustion chamber.

An igniter is connected to the spark plug 18.

An air flow sensor 20 (a heater type air flow meter in this reference) is provided at the right downstream of the air cleaner 7.

A throttle sensor 21*a* for detecting the opening angle the throttle valve. An idling switch 21*b* for detecting the full closing position of the throttle valve is installed as being linked with an axis of the throttle valve 5*a*.

There is provided a knock sensor 22 on a cylinder block 1*a* of the engine and a coolant sensor 24 with its tip exposing in a coolant passage 23 that communicates the right and left banks of the cylinder block 1*a*.

Further, an oxygen ($O_2$) sensor 30 is arranged at the fork portion of the exhaust manifold 9.

A crank rotor 25 is coupled coaxially with a crank shaft 1*b* mounted on the cylinder block 1*a* and on the periphery of the crank rotor 25 a crank angle sensor 26 (an electromagnetic pick up type or an optical pick up type) is provided.

Further, a cam angle sensor 28 (an electromagnetic pick up type or an optical pick up type) is provided on a cam rotor 27 that is connected coaxially with a cam shaft 1*c*.

The abovementioned crank angle sensor 26 and the cam angle sensor 28 may be an optical type, not limiting to an electromagnetic type.

Figure 15:
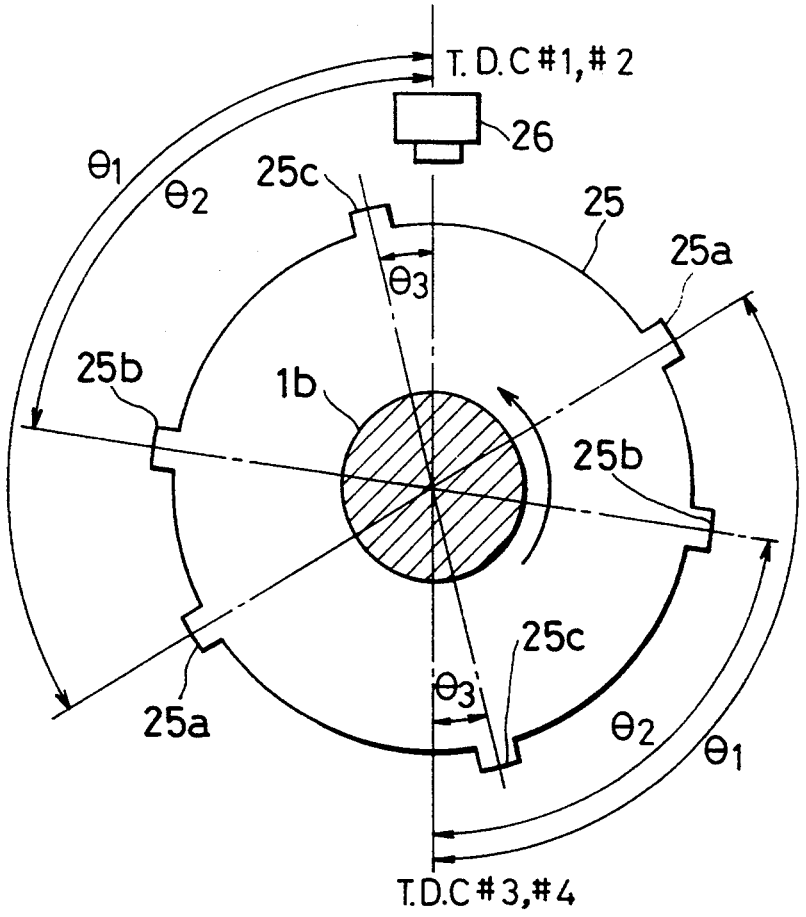
FIG. 15 is a schematic front view of a crank rotor and a crank angle sensor.

As referred in FIG. 15, the crank rotor 25 has projections 25*a*, 25*b* and 25*c* on its periphery. Those projections are positioned at angles $\theta_1$, $\theta_2$ and $\theta_3$ BTDC (Before Top Dead Center) . For example, $\theta_1$, $\theta_2$ and $\theta_3$ may be 97°, 65°, 10°, respectively.

The engine revolution number is calculated from the difference between the time when one projection passes through the crank angle sensor and the time when the next one does.

The projection 25*b* determines a standard crank angle for setting the ignition timing and the projection 25*c* does a standard crank angle for determining the fuel injection start timing at engine start. The projection 25*c* further produces the crank angle indicating a fixed ignition timing at engine start.

Figure 16:
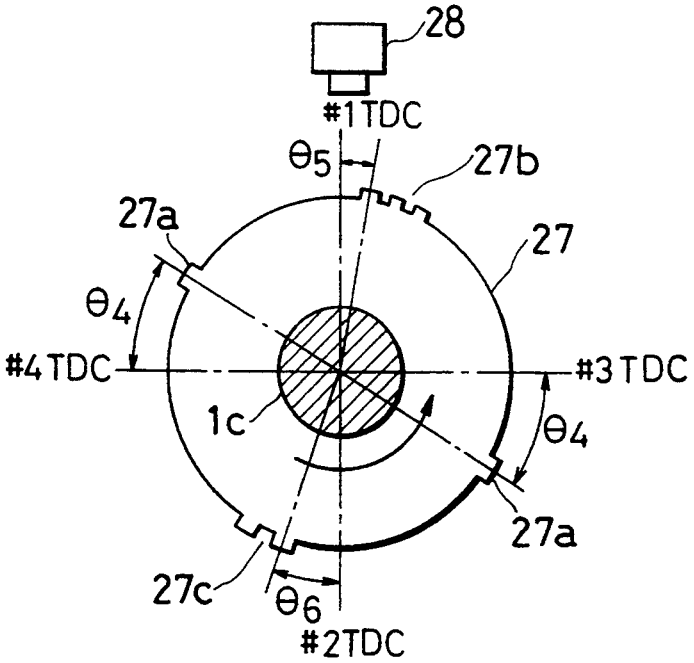
FIG. 16 is a schematic front view of a cam rotor and a cam angle sensor.

On the other hand, as referred in FIG. 16, the cam rotor has projections 27*a*, 27*b* and 27*c* on its periphery. For example the projection 27*a* is located at the angle $\theta_4$($\theta_4$=20° for instance) ATDC (After Top Dead Center) for cylinders #3 and #4. The projection 27*b* is composed of three projections whose first one is located at the angle $\theta_5$($\theta_5$=5° for instance) for cylinder #1. Further, the projection 27*c* is composed of two projections whose first one is positioned at the angle $\theta_6$($\theta_6$=20° for instance) for #2 cylinder.

Figure 18:
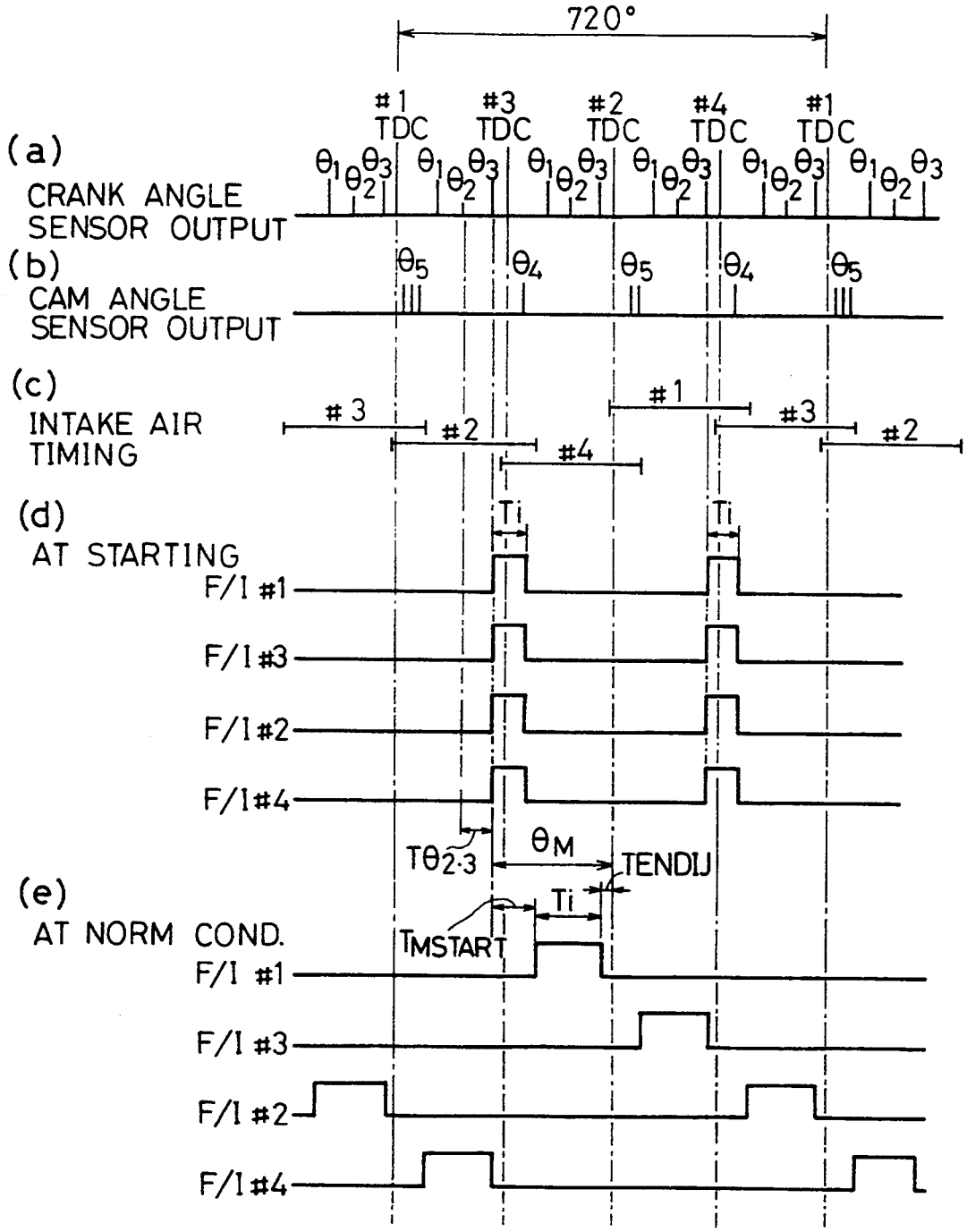
FIG. 18 is a timing chart indicating the timings of crank angle sensor output, cam angle sensor output and intake air.

As shown in FIG. 18, the discrimination of cylinder number is provided by the interruption of pulses which is detected from the cam sensor 28. In the present embodiment in FIG. 18, the fuel injection order is assumed to be #1, #3, #2 and #4 in this order.

Figure 17:
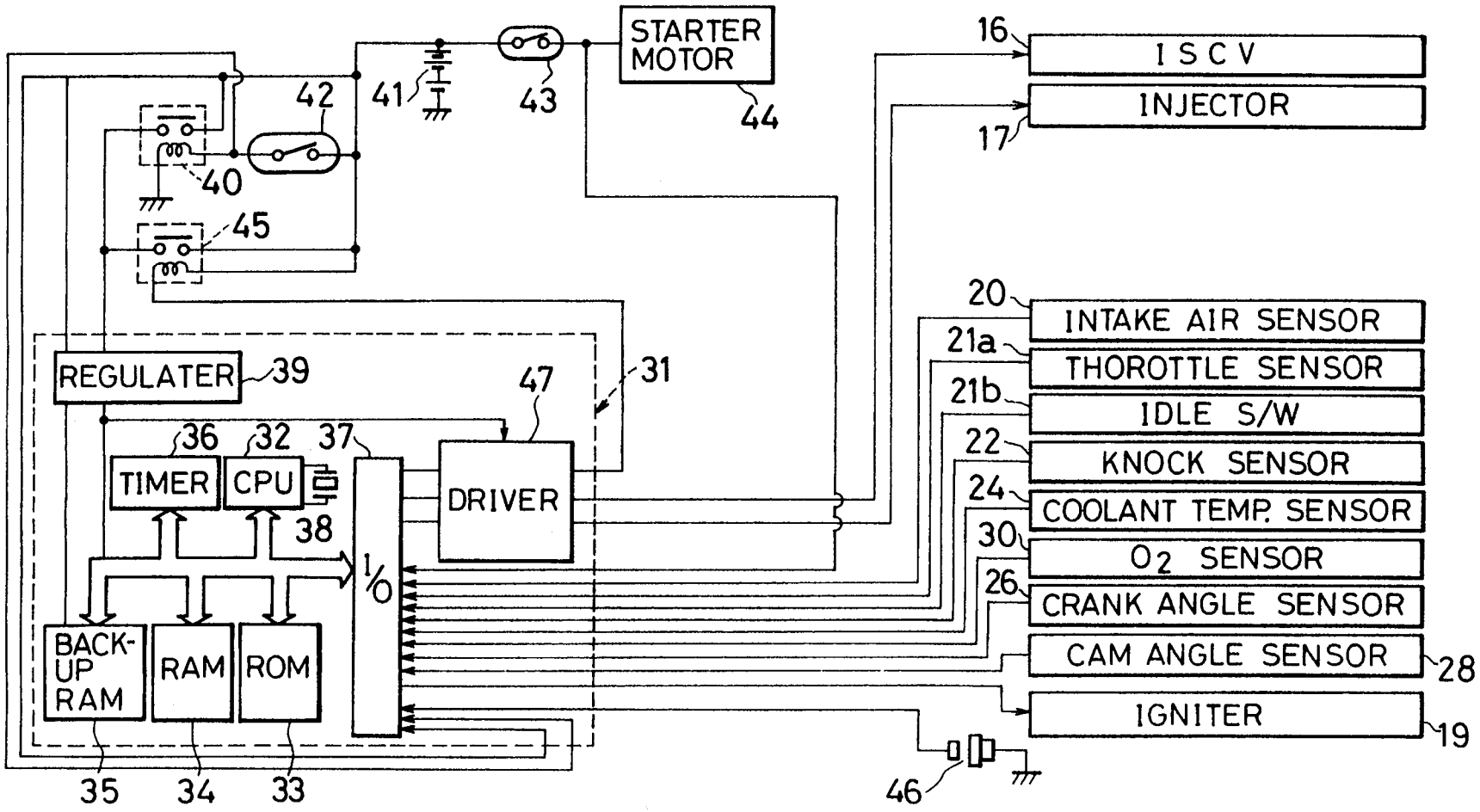
FIG. 17 is a functional block diagram of the control system.

Referring to FIG. 17, a reference numeral 31 denotes a control unit (ECU) comprising a CPU 32, an I/O interface 37 and a base line 38 which connects above devices each other. A voltage regulator 39 applies a specified stabilized voltage to each device. A backup voltage is always impressed on the backup RAM 35 by the voltage regulator 39. The voltage regulator is connected to a battery through an ECU relay 40 and an ignition key switch 42. A starter motor 44 is communicated with the battery 41 through a starter switch 43. Further, a self-shut relay 45 that acts as impressing a voltage on the ECU 31 for a predetermined time after ignition key OFF is connected to the ECU re lay 40 and the ignition key switch 42 in parallel. An input port of the I/O interface 37 is communicated with sensors 20, 21*a*, 22, 24, 30, 26, 28, an idle switch 21*b* and the battery 41. Further the input port is connected with the ignition key switch 42 to detect the ON-OFF state thereof and with the starter switch 43 to judge an engine start. A read memory switch 46 connected with the input port is a switch employed when the history of engine failures is read out. With the switch ON, the engine control system is changed from a general engine control mode to an engine check mode. An output port of said I/O interface is connected to an igniter 19 and further connected to the aforementioned ISCV 16 and a fuel injector 17 through a driver 47.

The air-fuel and ignition timing controls of the aforementioned ECU 31 are executed by the CPU 32 according to a control program stored in the ROM 33. In the CPU 32 the amount of induction air is calculated by an output signal of the air flow sensor 20.

The amount of fuel injection is calculated according to miscellaneous data memorized in the RAM 34 and the backup RAM 35.

The ignition timing is calculated according to data stored in the RAM and the backup RAM.

The pulse duration signal is transmitted from the I/O interface to the fuel injector 17 for corresponding cylinder through the driver 47 with a specified timing. The fuel injector injects the determined amount of fuel according to the pulse duration. The ignition signal is transmitted from the I/O interface to the igniter 19 with a specified timing, thereby the spark plug for a corresponding cylinder ignites and mixture gas supplied to the corresponding cylinder is burned.

The $O_2$ sensor 30 installed on the exhaust manifold 9 produces an output corresponding to the oxygen concentration in exhaust gases. The output signal of the $O_2$ sensor is compared to a standard voltage (slice level) after being subjected to waveform shaping. According to if this output voltage is above or below the slice level, the air-fuel ratio of mixture gas is judged to be "rich" or "lean". If the air-fuel ratio is determined to be away from a target value, the signal "how far and to which direction away from a target value the air-fuel ratio is" is feedbacked to the ECU. In response to this signal the ECU sends such pulses for fuel injection to fuel injectors as the air-fuel ratio becomes a target value.

Figure 1:
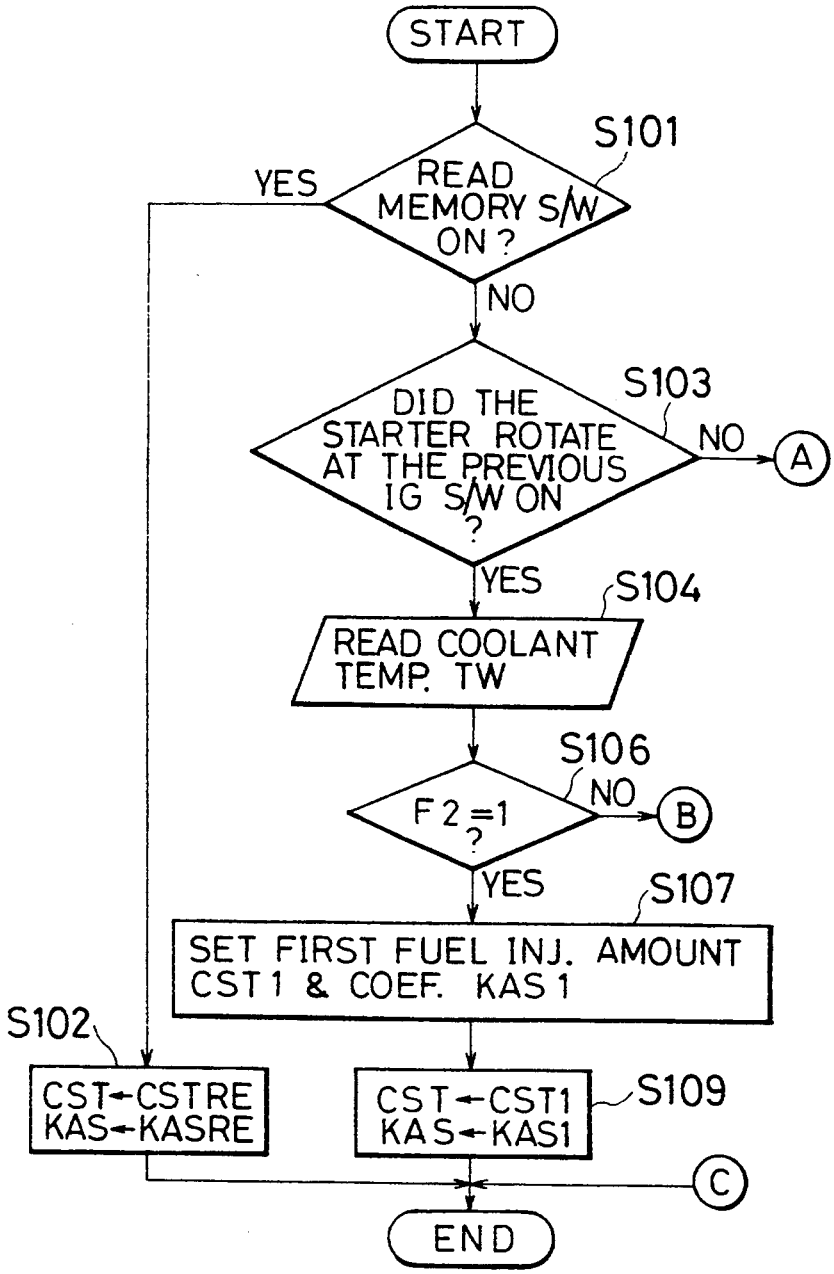
FIG. 1 and FIG. 2 are flowcharts showing the process for determining basic control values.
Figure 2:
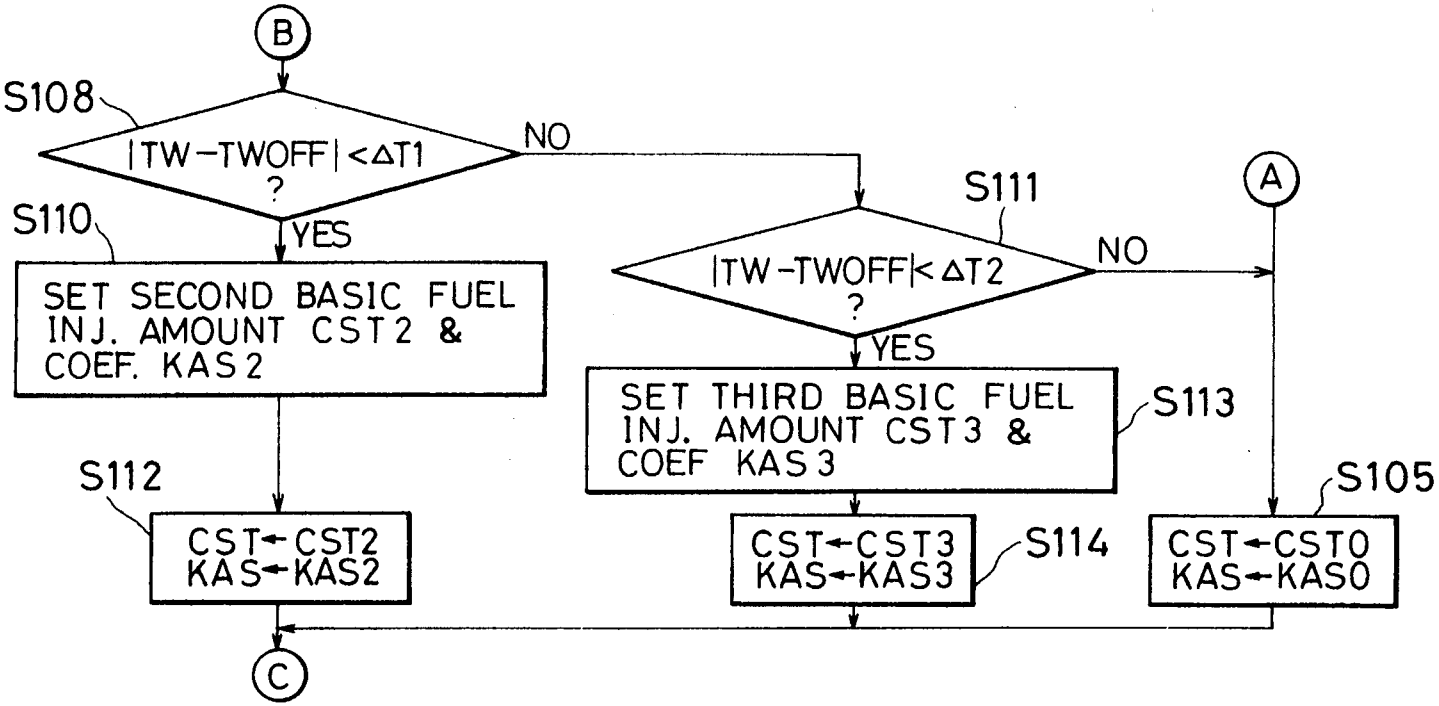

The CPU 31 performs the fuel injection amount control (air-fuel control) as follows: First, when the ignition key switch is turned on, a routine is executed just once for determining basic control values as shown in flowcharts of FIG. 1 and FIG. 2. That is to say, at a step S101 it is judged whether the read memory switch 46 is turned on or off.

In case where the read memory switch 46 is judged to be "ON", the process steps to S102 at which initial values for a start basic fuel injection amount CST and an after-start increment coefficient $K_{AS}$ are determined from the predetermined basic coefficients, $CST_{RE}$ and $K_{ASRE}$. Hereon, the case where the read memory switch is turned on is such a case as an engine is started and stopped repeatedly in a short period of time (under this circumstance, spark plugs tend to become wet by excessive liquid fuel to be fouled) for example, a case where an inspection is performed at a manufacturer's line end or an auto shop. Normally the switch is kept at "OFF" position.

The above predetermined basic coefficients $CST_{RE}$ and $K_{ASRE}$ are set smaller than those coefficients CST and $K_{AS}$ which are determined at the "OFF" position of the read memory switch, therefore the fuel injection amount $T_i$ calculated from these coefficients is decreased, whereby spark plug fouling can be prevented.

On the other hand, in case where the read memory switch is judged to be "OFF" at a step S101, the process goes to a step S103 at which it is judged if the starter switch 42 had been "ON" when the ignition key switch was turned "ON" at a precedent start. If it is judged that the starter switch had been "ON", the process steps to a step S104.

On the other hand, if it is judged that the starter switch had not been "ON", that is to say, in such a case where the ignition key switch is kept at a position where only accessories work without turning the starter motor "ON", the process goes to a step S105 where the initial values for a start basic fuel injection amount CST and an after-start increment coefficient $K_{AS}$ are determined from the predetermined coefficients $CST_0$ and $K_{AS0}$ and herein the routine returns to the main routine. The coefficients $CST_0$ and $K_{AS0}$ determined here are normal values on which no correction has been made. In other words, since the starter switch 43 has not been turned "ON" and therefore no fuel has been injected from the fuel injector there is no need that the fuel injection amount $T_i$ is decreased. The judgment is made as to whether or not the ignition key switch has been turned "OFF" without switching "ON" the starter switch 43 by referring a flag which is stored in the backup RAM 35. The flag, for instance, is set upon switching the ignition key switch "ON" and is cleared upon switching the starter switch "ON".

When the process goes from a step S103 to a step S104 as mentioned above, a coolant temperature 24 $T_W$ is calculated from the output voltage of the coolant temperature sensor 24 at the step S104.

At the next step S106, the process steps to a step S107 if a flag $F_2$ stored in the backup RAM 35 is equal to 1, and it goes to a step S108 if the flag is equal to 0. The flag $F_2$ acts as an indicator showing whether the self-shut relay 45 is turned on or not. By means of this flag it is judged if a restart of an engine is performed within a relatively short period since the precedent engine stop or not. The process for setting said flag is explained in a routine of the self-shut relay's ON-OFF control described hereafter. The flag is set upon an engine stop and cleared in a specified elapsed time $C_S$ since stopping the engine.

When it is determined that the engine has been started in a relatively short period since the precedent engine stop, e.g., $F_2$ is equal to 1, then the program steps to a step S107.

At the step S107, a 1st start basic fuel injection amount $CST_1$ and a 1st after-start increment coefficient $K_{ASI}$ are determined according to a 1st start basic fuel injection amount map $TBCST_1$ and a 1st after-start increment coefficient $TBK_{AS1}$ both of which are stored in the ROM 33 with reference to the coolant temperature $T_W$ determined at a step S104.

At the next step S109 the start basic fuel injection amount CST is rewritten to $CST_1$ and the after-start increment coefficient $K_{AS}$ to $K_{AS1}$, thus this routine terminates.

On the other hand, when it is determined that $F_2$ is equal to 0, the process goes to a step S108 where the absolute value of the difference between the above coolant temperature $T_W$ and the coolant temperature at the precedent engine stop $T_{WOFF}$ is compared to a 1st predetermined temperature difference $\Delta T_i$. If $|T_W - T_{WOFF}|$ is smaller than $\Delta T_1$, the program steps to step S110 and if $|T_W - T_{WOFF}|$ is equal to or larger than $T_1$, it goes to a step S111.

At the step S111, a 2nd start basic fuel injection amount $CST_2$ and a 2nd after-start increment coefficient $K_{AS2}$ are determined according to a 2nd start basic fuel injection amount map $TBCST_2$ and a 2nd after-start increment coefficient map $TBK_{AS2}$ which are stored in the ROM 33 with reference to the coolant temperature $T_W$.

At the next step S112 the start basic fuel injection amount CST is rewritten to $CST_2$ and the after-start increment coefficient $K_{AS}$ to $K_{AS2}$, thus this routine terminates.

If the process goes to a step S111, the absolute value of the difference between the aforementioned coolant temperature $T_W$ and the coolant temperature at the precedent engine stop $T_{WOFF}$ is compared with a 2nd predetermined temperature difference $\Delta T2$ ($\Delta T2$ is larger than $\Delta T1$).

In case where $|T_W - T_{WOFF}|$ is smaller than $\Delta T2$, the process goes to a step S113 and in case where $|T_W - T_{WOFF}|$ is equal to or greater than $\Delta T2$, it goes to the step S105 as described before.

At the step S105, the start fuel injection amount CST is rewritten to $CST_0$ and the after-start increment coefficient $K_{AS}$ to $K_{AS0}$ and then the routine returns to the main routine.

If the process goes to a step S113 from a step S111, a 3rd start basic fuel injection amount $CST_3$ and a 3rd after-start increment coefficient $K_{AS3}$ are determined according to a 3rd start basic fuel injection amount map $TBCST_3$ and a 3rd after-start increment coefficient map $TBK_{AS3}$ which are stored in the ROM 33 based on the coolant temperature $T_W$.

At the next step S114, the start basic fuel injection amount CST is rewritten to $CST_3$ and the after-start increment coefficient $K_{AS}$ to $K_{AS3}$, thus this routine terminates.

Figure 11:
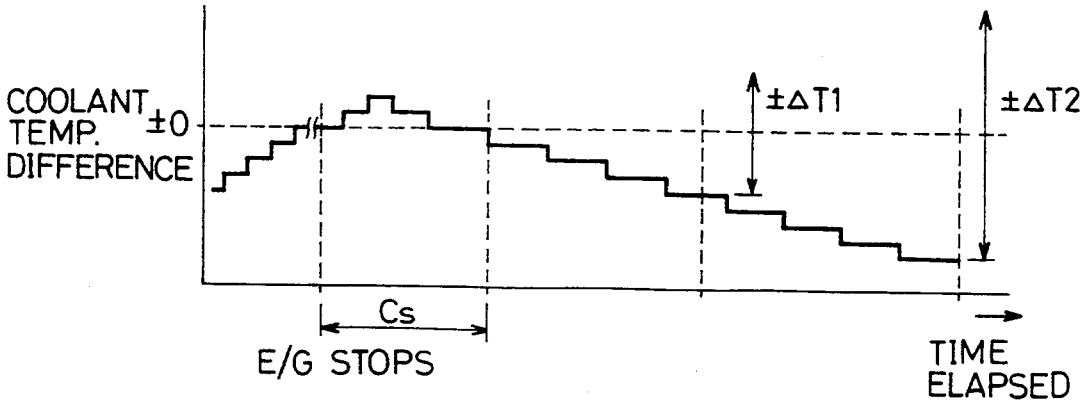
FIG. 11 is a schematic diagram showing the change of coolant temperature after engine stop.

FIG. 11 indicates a change of the coolant temperature $T_W$ against time. In the aforementioned flow charts a judgment is made as to whether or not an elapsed time from an engine stop to an engine start is relatively short by referring the self-shut relay ON/OFF flag which shows the ON/OFF state of a self-shut relay 45. After this elapsed time exceeds a predetermined time $C_S$, the decision of the elapsed time (a time from engine stop to engine start) is made roughly without employing a timer. Namely, in the embodiment of the present invention, an elapsed time exceeding a time $C_S$ is designed to be replaced with a temperature difference between an engine stop and an engine start. In this reference a temperature difference $\Delta T1$ and a 2nd temperature difference $\Delta T2$ ($\Delta T2$ is larger than $\Delta T1$) are provided.

Figure 12:
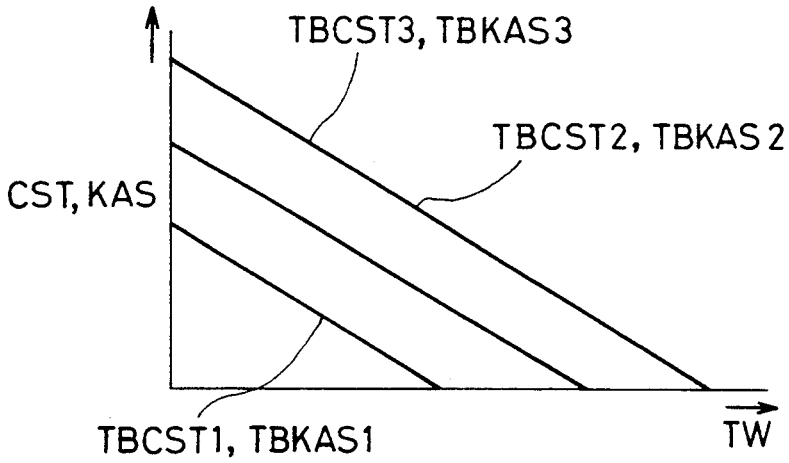
FIG. 12 is a map for determining the basic fuel injection amount at engine start.

Referring to FIG. 12, these maps are for determining the start basic fuel injection amount CST and the after-start increment coefficient $K_{AS}$ according to the coolant temperature $T_W$. The relationships between CST and $T_W$ or between $K_{AS}$ and $T_W$ are indicated as several parameters representing a time elapsed from an engine stop to an engine start. In this reference, maps $TBCST_I$, $TBCST_2$ and $TBCST_3$ for determining CST and maps $TBK_{ASI}$, $TBK_{AS2}$ and $TBK_{AS3}$ for determining $K_{AS}$ are provided.

The amount of residual fuel around Cylinders abounds most immediately after an engine stop and decreases as time elapses. Further, the higher the coolant temperature at an engine stop, the faster the residual fuel evaporates. Therefore, the start basic fuel injection amount and the after-start increment coefficient are reduced so much as the elapsed time since a precedent engine stop becomes longer and the coolant temperature at the engine stop becomes higher as shown in FIG. 12. The figures as to how much fuel to be reduced are obtained experimentally and stored in the ROM 33.

Figure 3:
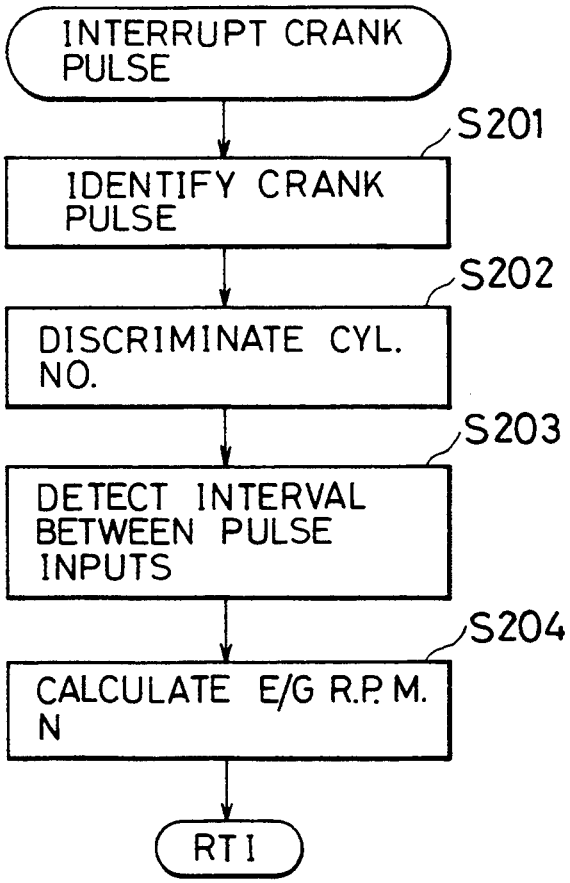
FIG. 3 is a flowchart showing the process for discriminating cylinder numbers and calculating engine revolution numbers.
Figure 4:
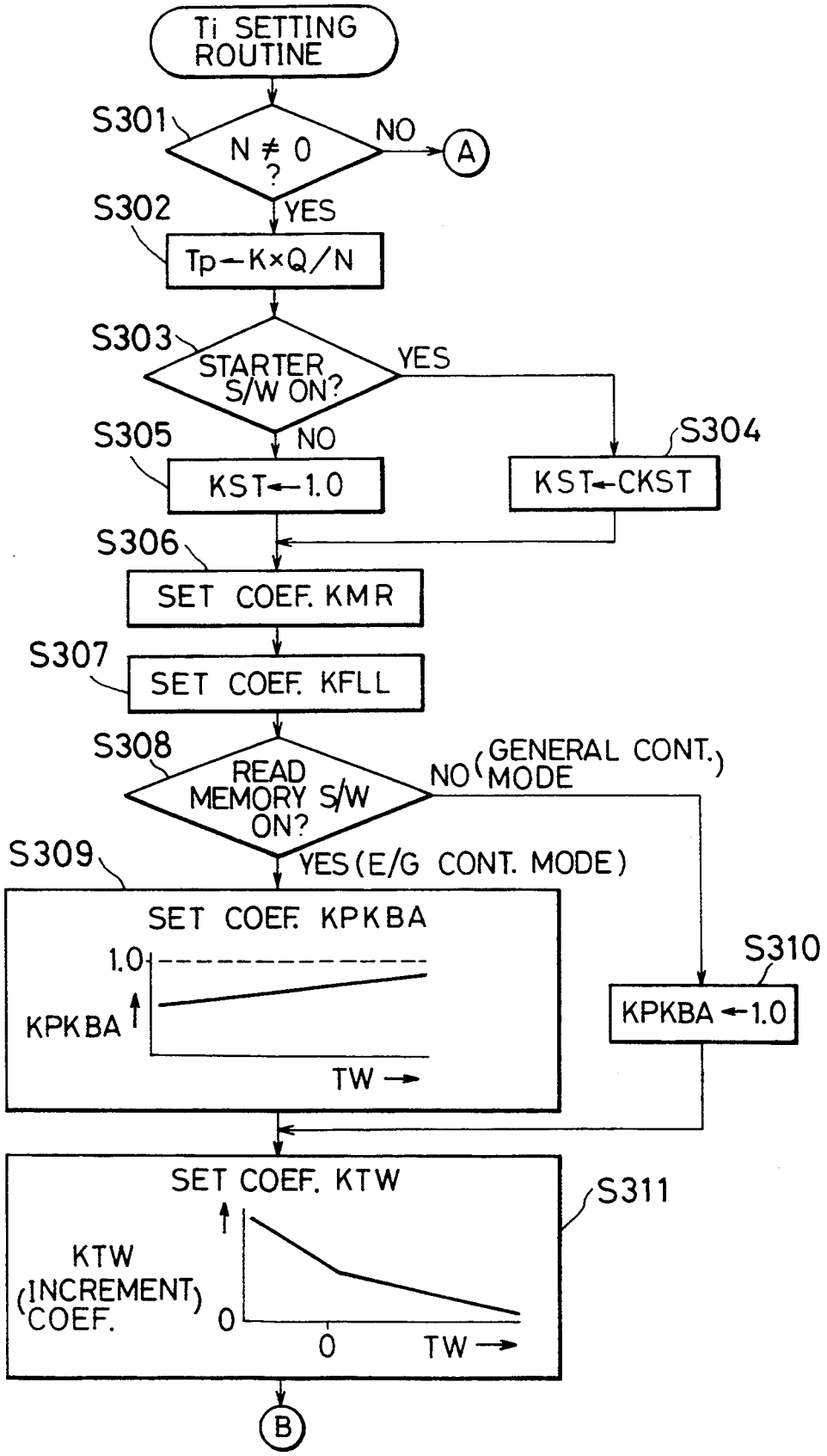
FIG. 4 to FIG. 7 are flowcharts showing routines for determining fuel injection amount.
Figure 5:
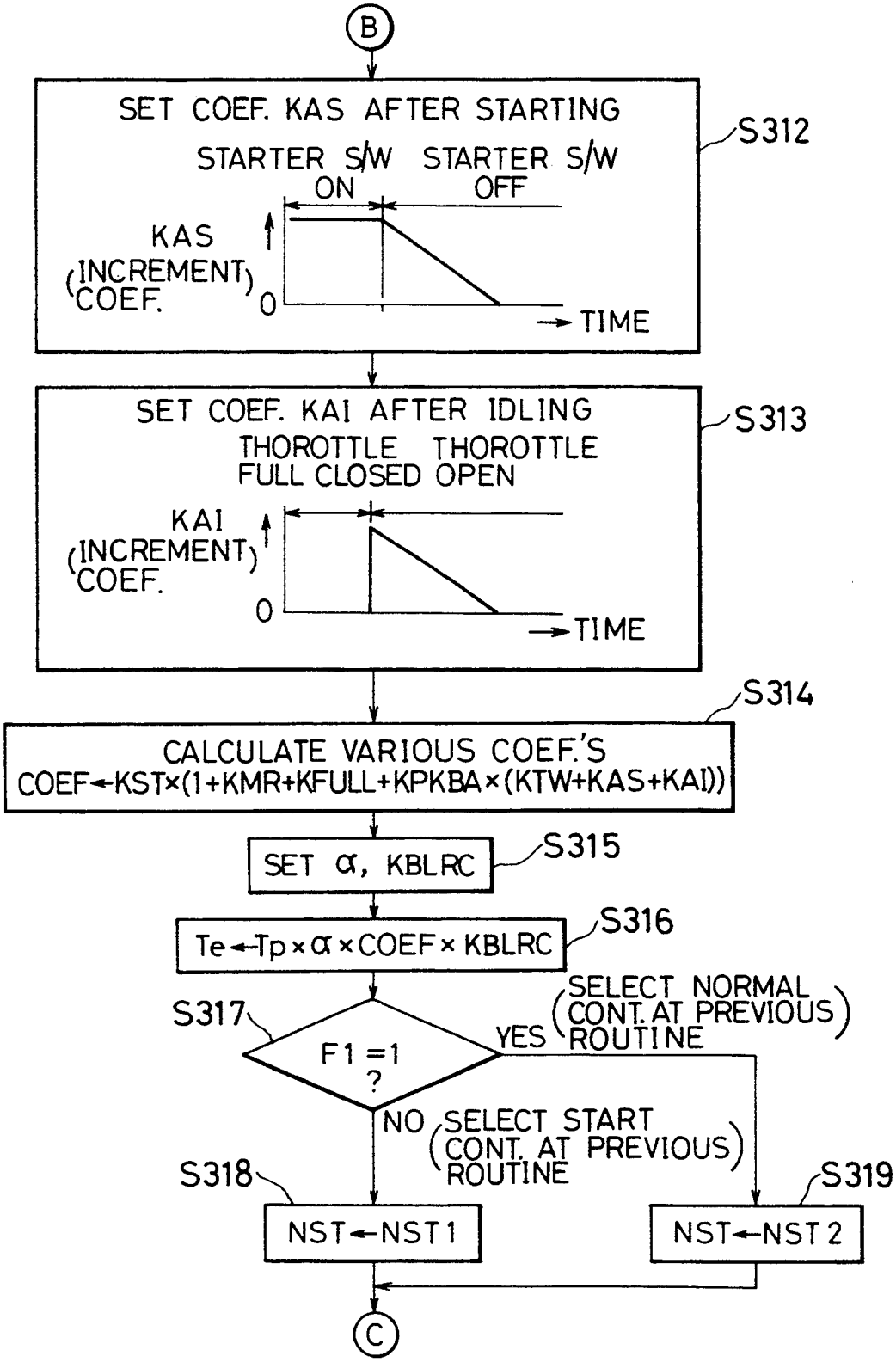

When an engine is started by the starter 44 and a crank shaft begins to rotate, a crank angle sensor 26 generates crank angle pulses and then a routine as indicated in FIG. 3 starts to discriminate cylinder numbers and to calculate engine revolution numbers with an interruption of the crank angle pulses. At a step S201 crank pulses are identified according to an output of a cam angle sensor and at a step S202 a cylinder number in which fuel is to be injected is discriminated. Referring to a time chart in FIG. 18, for instance, when a cam pulse $\theta_5$ (a projection 27*b*) is output from the cam angle sensor 28, the next compression top dead center is known to be a #3 cylinder and the cylinder in which fuel is to be injected is discriminated as a #4 cylinder coming second of that cylinder.

When a cam pulse $\theta_4$ (a projection 27*a*) is output following the cam pulse $\theta_5$, the next compression top dead center is identified to be a #2 cylinder and the cylinder in which fuel is to be injected is determined to be a #1 cylinder coming second of that cylinder.

Likewise, a cam pulse $\theta_6$ (a projection 27*c*) indicates that the next compression top dead center is a #4 cylinder and the cylinder to be injected in is a #3 cylinder coming second of that cylinder. Also likewise, a cam pulse $\theta_4$ (a projection 27*a*) indicates that the next compression top dead center is a #1 cylinder and the cylinder to be injected in is a #2 cylinder coming second of that cylinder.

A crank pulse produced from the crank angle sensor 26 after a cam pulse is output from the cam angle sensor 28 indicates a crank angle $\theta_1$ BTDC and the next coming crank pulse does a crank angle $\theta_2$ BTDC.

In a four cycle four cylinder engine of this embodiment the combustion comes at a cylinder #1 to #2 to #3 to #4 in this order. If a combustion top dead center comes at the "i" th cylinder (#1 for example), the cylinder in which fuel is injected should be the "i+2" cylinder (#2) and next one is the "i+4" (#4) . In this reference the fuel injection is performed once per each cylinder sequentially during the 720° of crank angle (corresponding to 2 rotations of crank shaft).

As referring to the chart (c) of FIG. 18, the intake valve opening in a cylinder starts immediately before a start of the induction stroke (BTDC 5° of crank shaft, for example) and the closing finishes at the beginning of compression stroke. Accordingly, in order to finish a fuel injection just before the opening start of the intake valve for the cylinder, it is necessary to determine the fuel injection timing for the cylinder according to a crank pulse coming to at least 2nd precedent cylinder.

After the discrimination of a cylinder where fuel injection is performed at a step S203 in FIG. 3 a time interval between pulse inputs is counted. The time interval is a period, for example, from a time when a pulse $\theta_3$ is input to a time when a pulse $\theta_1$ is input and denoted here in this example as $T_{\theta 3-1}$. $T_{\theta 2-3}$ indicates an interval between the pulse $\theta_2$ and $\theta_3$ likewise.

At the next step S204, an engine revolution number is calculated from either above intervals $T_{\theta 3-1}$ or $T_{\theta 2-3}$, the revolution number being stored in a specified address of the RAM 34 and this routine returns to the main routine.

Referring to FIG. 4 to 7, the routines for setting fuel injection amount are shown. These routines are executed every specified time.

At a step S301, in this routine an engine revolution number N stored in the RAM 34 is read. If N is not equal to 0, the process goes to a step S302 and if it is equal to 0, judging that an engine has been stopped, the routine finishes.

Stepping to a step S302, a basic fuel injection pulse duration $T_P$ (corresponding to a basic fuel injection amount per one simultaneous injection) is calculated from the engine revolution number N, the intake air amount Q that is calculated from the output voltage of the intake air sensor 20 and the injector correction coefficient K.

At the next step S303, the operational condition of a starter switch 43 is checked up. In case where the starter switch 43 is "ON" (during an engine cranking), the start increment coefficient $K_{ST}$ stored in a specified address of the RAM 34 is rewritten to a determined value CKST(CKST>1) and the process steps to a step S306. In case where the starter switch is "OFF" (firing start), the process goes to a step S305 where the $K_{ST}$ is set to 1 and steps to a step S306. This start increment coefficient $K_{ST}$ is set to a value larger than 1 only during an engine cranking in order to allow a good startability of the engine.

At a step S306, a mixture ratio allocation coefficient $K_{MR}$ is determined based on the abovementioned basic fuel injection amount $T_P$ and the engine revolution number N. The mixture ratio allocation coefficient $K_{MR}$ is picked up from the map stored in a plurality of addresses in the ROM 33. The coefficient $K_{MR}$ is obtained experimentally so as for the mixture ratio to be optimized at each area identified by the basic fuel injection amount $T_P$ and the engine revolution number N as mentioned above. The mixture ratio allocation coefficient enables an engine to secure a high precision control even when characteristics of an injector or an intake air sensor deviate.

At the next step S307, a full increment coefficient $K_{FULL}$ is determined according to an engine revolution number N, a throttle valve opening angle $T_h$ and a basic fuel injection amount $T_P$. The full increment coefficient $K_{FULL}$ is determined from a map parametrizing the engine revolution number N at a wide open throttle or at a high load of engine, whereby a high power is secured when a power is needed. Under the conditions excepting a wide open throttle and a high load, $K_{FULL}$ is set to 0.

Stepping into a step S308, the contact condition of the read memory switch 46 is checked up. In case of "ON", the process goes to a step S309 where a line-off fuel coefficient $K_{PKBA}$ is determined from the predetermined map based on the coolant temperature $T_W$. The object of the coefficient $K_{PKBA}$ is to make a correction for fuel injection so as not to enrich air-fuel ratio excessively in case where frequent engine starts and stops are provided on an occasion of engine inspection with a read memory switch "ON". The coefficient $K_{PKBA}$ is so determined as becoming smaller in accordance with lower coolant temperature for the reason that the lower a coolant temperature becomes, the richer a fuel ratio does. In case of "OFF," on the other hand, the process goes to a step S310 where said line-off fuel coefficient $K_{PKBA}$ is rewritten to 1 and then steps to a step S311.

At a step S311, a coolant temperature increment coefficient $K_{TW}$ whose object to secure a driveability under the cold condition of engine is determined from a map. The coefficient $K_{TW}$ is so decided as becoming larger when a coolant temperature becomes lower.

At the next step S312, an after-start increment coefficient $K_{AS}$ is determined. $K_{AS}$ acts as keeping an engine revolution immediately after an engine start in stability. An initial value of the after-start increment coefficient $K_{AS}$ is established in the aforementioned routine and then gradually reduced to 0% at a specified rate each time this routine is carried out after the starter switch is turned "OFF".

Stepping to a step S313, here an after-idle increment coefficient $K_{AI}$ is calculated. The object of the coefficient $K_{AI}$ is to prevent a reluctant rise in engine revolution which tends to occur immediately after an idle release. The initial value of $K_{AI}$ is set based on a coolant temperature TW when a vehicle speed is below a specified value (15 km/h for example) and immediately after an idle switch is turned from "ON") fully closed position of a throttle valve) to "OFF" and after that gradually reduced to 0% at a specified rate each time this routine is carried out.

At a step S314 the increment coefficients COEFs are calculated according to various increment coefficients determined above using the following formula:

$$COEF=K_{ST}X(1+K_{MR}+K_{FULL}+K_{PKBA}x(K_{TW}+K_{AS}+K_{AI})).$$

At the next step S315, an air-fuel ratio feedback correction coefficient for drawing the air-fuel ratio close to a target value based on an output voltage of the $O_2$ sensor 30 is calculated and at the same time an adaptive learning correction coefficient $K_{BLRC}$ that corrects a basic fuel injection amount $T_P$ is determined.

At a step S316, further, an effective pulse duration $T_e$ is calculated by correcting $T_P$ by the air-fuel ratio feedback correction coefficient $\alpha$, the various increment coefficients COEFs and the adaptive learning correction coefficient $K_{BLRC}$. The formula is: $T_e=T_P\times\alpha\times COEF\times K_{BLRC}$.

At a step S317, a normal control discrimination flag $F_1$ is checked up. If $F_1$ is equal to 0 (which means that a start control has been selected in carrying out a previous routine), the process goes to a step S318 where an engine revolution number $N_{ST}$ to discriminate between a start control and a normal one is rewritten to a predetermined value $N_{ST1}$ (500 rpm for instance) and then steps to a step S320. If $F_1$ is equal to 1 (a normal control selected in carrying out a previous routine), the process goes to a step S319 at which the engine revolution number $N_{ST}$ to discriminate between a start control and a normal one is rewritten to a predetermined value $N_{ST2}$ ($N_{ST1}>N_{ST2}$), for example 300 rpm and then proceeds to a step S320.

Figure 13:
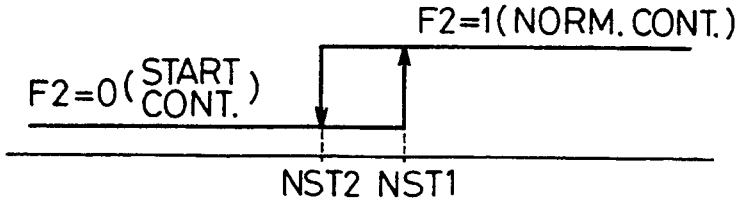
FIG. 13 is a schematic diagram showing the switching operation between the starting control and the normal control.

The normal control discrimination flag $F_1$ as abovementioned is set at a step S335 described hereinafter and at a step S332 the $F_1$ is cleared. As shown in FIG. 13, a hunting of the control system that at the transferring process from a start control to a normal one can be prevented by designing a hysteresis in the engine revolution number $N_{ST}$.

Figure 6:
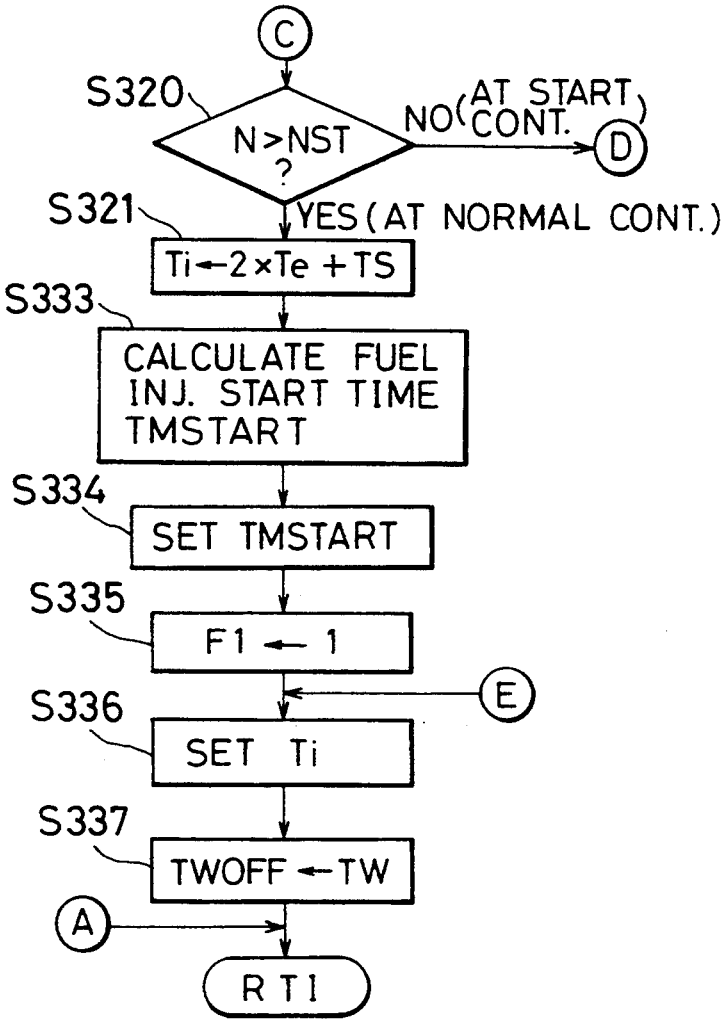

At a step S320 as shown in FIG. 6, the engine revolution number N is compared with the above $N_{ST}$. In case where N is greater than $N_{ST}$, the process proceeds to a step S321 to carry out a normal control and in case where N is equal to or less than $N_{ST}$, it goes to a step S322 for carrying out a start control.

Figure 7:
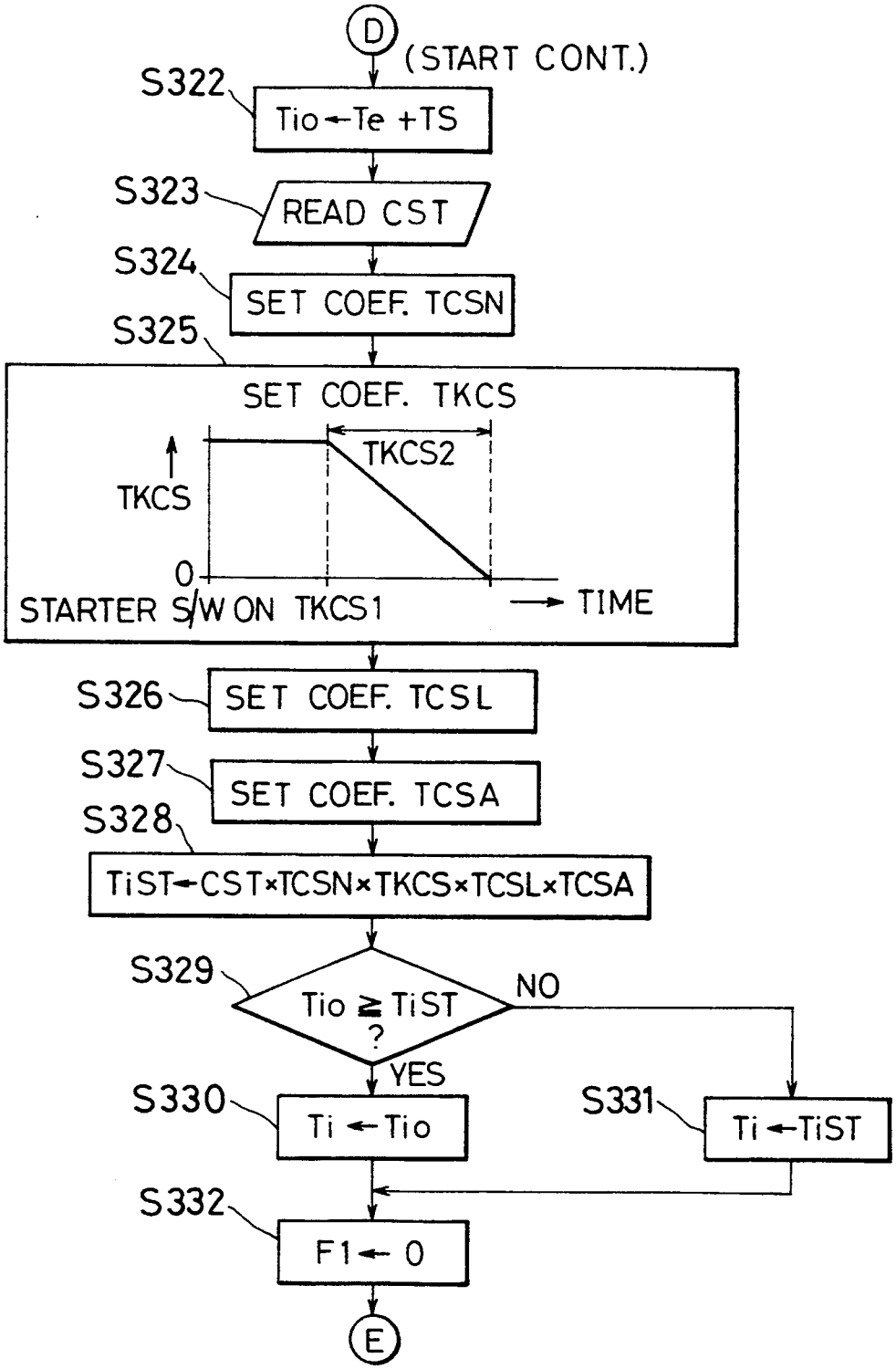

The process proceeds from a step S320 to a step S322 as indicated in FIG. 7 where the effective pulse duration $T_e$ above mentioned is added by a voltage correction pulse duration $T_S$ and thus a start injection pulse duration $T_{iO}$ is determined. Namely, the formula is: $T_{iO}=T_e+T_S$.

Then at a step S323, the start basic fuel injection amount CST that has been set in the aforementioned routine for determining basic values is read.

At the next step S324, an engine revolution correction coefficient $T_{CSN}$ is determined by referring to a map parametrizing the engine revolution number N.

At step S325 a time correction coefficient $T_{KCS}$ is set. The time correction coefficient $T_{KCS}$ is fixed at 1 for a predetermined time $T_{KCS1}$ since the starter switch 43 is turned on and then gradually reduced to 0 each time the routine is carried out after a predetermined time $T_{KCS2}$. Therefore, unless a start control is finished within a predetermined time $T_{KCS1}$ since the starter switch 43 is turned on, a cold start pulse $T_{iST}$ that is determined at a step S328 is gradually reduced to 0 after an elapsed time $T_{KCS2}$.

At a step S326 a voltage correction coefficient $T_{CSL}$ is determined by referring a map parametrizing a battery voltage VB and at the next step S327 a throttle opening angle correction coefficient $T_{CSA}$ is set, employing a map parametrizing a throttle opening angle $T_h$. At a step S328 a cold start pulse duration $T_{iST}$ is calculated by multiplying the aforementioned start basic fuel injection amount CST by the correction coefficients $T_{CSN}$, $T_{KCS}$, $T_{CSL}$ and $T_{CSA}$. The formula is: $T_{iST}CST \times T_{CSN} \times T_{KCS} \times T_{CSL} \times T_{CSA}$.

Then at a step S329, the start fuel injection pulse duration $T_{iO}$ as mentioned before is compared with the cold start pulse duration $T_{iST}$. If $T_{iO}$ is equal to or greater than $T_{iST}$, the process proceeds to a step S330 where $T_i$ is rewritten to $T_{iO}$. If $T_{iO}$ is smaller than $T_{iST}$, then the process goes to a step S331 where $T_i$ is rewritten to $T_{iO}$.

In summary in the start control, the fuel injection pulse $T_i$ chooses a start injection pulse duration $T_{iO}$ or a cold start pulse duration $T_{iST}$, whichever is greater.

At a step S332 a control discrimination flag $F_1$ is cleared and the process into a step S336 where the fuel injection pulse duration $T_i$ as determined above is set.

On the other hand, at the step S320, in case where it is judged that N is greater than $N_{ST}$ the process enters into a normal control.

At a step S321, a fuel injection pulse duration $T_i$ is calculated by adding a voltage correction pulse duration $T_S$ to a doubled effective pulse duration $T_e$ according to the following formula: $T_i = T_S + 2 \times T_e$. As shown in FIG. 18, under the normal control a sequential fuel injection (one injection per two engine revolutions) is performed, so that a doubled fuel ($2 \times T_e$) is needed, comparing to a simultaneous injection in a start control.

At the next step S333 a fuel injection start timing $T_{MSTART}$ is calculated. In this particular embodiment, so-called a time control method is introduced, so that the fuel injection start timing is controlled by a timer in the ECU. The fuel injection start timing $T_{MSTART}$ comes earlier than the air induction timing (5° BTDC of crank angle, for example). In this embodiment a fuel injection is designed to finish at a determined crank angle TENDIJ (30° before the induction top dead center of each cylinder for instance). The fuel injection start timing TMSTART is calculated as follows:

$$T_{MSTART} = (T_{\theta 2\text{-}3}/\theta_{2\text{-}3}) X \theta_M \text{-} (T_i + (T_{\theta 2\text{-}3}/\theta_{2\text{-}3}) \times TENDIJ).$$

where, $T_{\theta 2\text{-}3}$ is time interval between $\theta_2$ pulse input and $\theta_3$ pulse input, $\theta_{2\text{-}3}$ a crank angle between $\theta_2$ and $\theta_3$, $\theta_M$ is a crank angle between $\theta_3$ and an induction top dead center of the cylinder where fuel is to be injected, $\theta_M$ is predetermined between 730° and 10° of crank angle, $T_i$ is a newest value of fuel injection pulse duration, and TENDIJ is a crank angle where fuel injection finishes.

At a step S334, the fuel injection start timing $T_{MSTART}$ as calculated above is set in a timer and at a step S335 a normal control discrimination flag $F_1$ is set to 1.

At a step S336, the fuel injection pulse duration $T_i$ that has been calculated at a step S321 is set.

At the next step S337, the coolant temperature at a previous engine stop $T_{WOFF}$ stored in the backup RAM 35 is rewritten to a current coolant temperature $T_W$ and thus the routine returns to the main routine.

Figure 8:
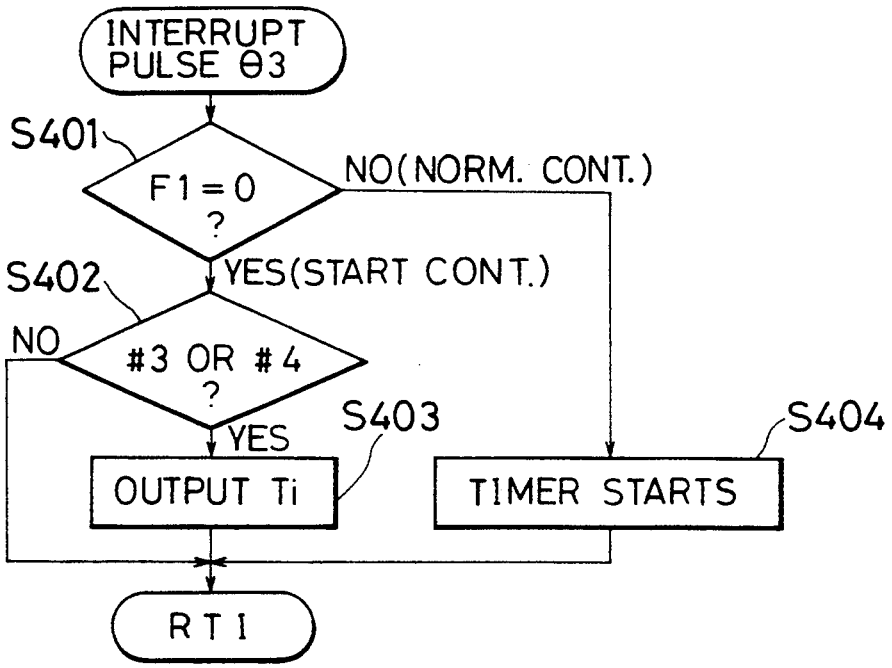
FIG. 8 is a flowchart showing a routine for determining the fuel injection timing at an engine start and the fuel injection start timing at the normal operating condition.

In a normal control after a firing start of an engine the fuel injection start timing $T_{MSTART}$ (the fuel injection pulse duration output in a start control, similarly) is provided by a routine shown in FIG. 8. This routine is started by an interruption of the pulse $\theta_3$.

At a step S401 it is judged whether or not a normal control discrimination flag $F_1$ is equal to 0. If the flag $F_1$ is equal to 0 (a start control), the process goes to a step S402 where the input pulse $\theta_3$ is judged as to if it comes from #3 or #4 cylinders.

In case of the pulse originated from #3 or #4 cylinders the process proceeds to a step S403 where a signal for the fuel injection pulse duration $T_i$ is output to the fuel injectors for all cylinders and then returns to the main routine.

In case of the pulse not originated from #3 or #4 cylinders (originated from #1 or #2 cylinders), the process returns to the main routine directly.

On the other hand, if the flag $F_1$ is equal to 1 (a normal control), the process goes to a step S404 where a timer for the fuel injection timing $T_{MSTART}$ starts and then returns to the main routine. When the timer for $T_{MSTART}$ (whose trigger is a pulse $\theta_3$) starts, the signal for $T_{MSTART}$ interrupts into routine for controlling sequential fuel injection as shown in FIG. 9.

Figure 9:
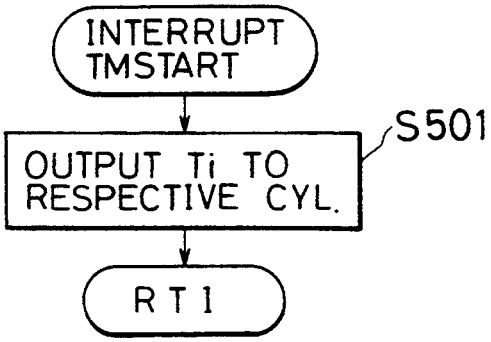
FIG. 9 is a flowchart showing the fuel injection control at the normal operating condition.

In the routine of FIG. 9, at a step S501, an output signal $T_i$ is transmitted to drive a fuel injector for the object cylinder and then this routine terminates.

Figure 10:
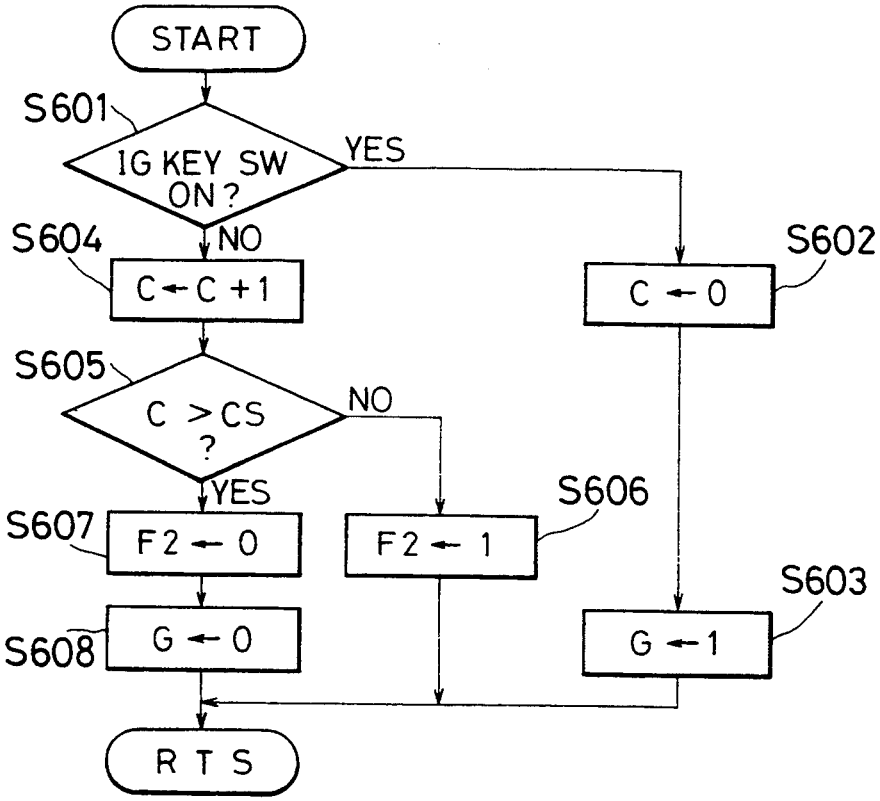
FIG. 10 is a flowchart showing the operation of a self-shut relay.

FIG. 10 shows a control routine for a self-shut relay. This routine is carried out every determined time while electric power is being supplied to the ECU 31.

At a step S601, it is judged whether or not an ignition key switch 42 is turned on.

In case where the ignition key switch is turned "ON" at the step S601, the process goes to a step S602 in which a value C (a value representing an elapsed time since the ignition key OFF) is cleared (C=0) and at a step S603 a command signal G (G=1 means a self-shut relay "ON" and G=0 does "OFF") is set to 1 to turn the self-shut relay on and then the routine returns to the main routine.

In case of "OFF" at the step S601, the process goes to a step S604 where the value C is counted up by 1.

At the next step S605, the value C is compared to a predetermined value $C_S$ (any value corresponding to minutes, for example). If C is equal to or smaller than $C_S$, the process goes to a step S606 where an ON/OFF discrimination flag $F_2$ of the self-shut relay is set to 1 and returns to the main routine. If C is greater than $C_S$, the process steps to a step S607 where $F_2$ is cleared ($F_2$=0) and at the next step S608 the output G from the I/O interface 37 is cleared (G=0), thereby the self-shut relay is turned off and returns to the main routine.

In summary this routine acts as applying power to the ECU 31 for a specified time even after engine stop in order to operate a timer. The flag $F_2$ generated in this routine is an important information which will be employed at the next engine start.

While presently preferred embodiments of the present invention have been shown and described, it is to be understood that these disclosures are for the purpose of illustration and that various changes and modifications may be made without departing from the scope of the invention as set forth in the appended claims.

What is claimed is:

1. A system for controlling an amount of fuel for an internal combustion engine having, a fuel injector, an idle speed control valve for controlling idle speed, an ECU to control an air-fuel mixture and [an]ignition timing of said engine, a starter motor, a starter switch for switching said starter motor on and off, a self-shut relay for supplying said ECU with electric power for a predetermined time period, an ignition key switch, a read memory switch for diagnosing said engine, an intake air sensor for measuring intake air amount, a throttle sensor for detecting a throttle opening angle, an idle switch for detecting an idling condition of said engine, a coolant temperature sensor for detecting engine temperature, an oxygen ($O_2$) sensor for detecting residual oxygen concentration in exhaust gases, a crank angle sensor for detecting an engine speed, a cam angle sensor for discriminating a cylinder number, and an igniter for producing an ignition voltage and for distributing an ignition current to a spark plug, the system comprising:

judging means responsive to said engine speed for judging whether or not cranking is started within a predetermined elapsed time from a precedent engine stop and for generating a cranking signal;

determining means responsive to said cranking signal for determining an initial value for a start basic fuel injection amount and an after-start increment coefficient according to predetermined data when said cranking is started within said predetermined time;

discriminating means for determining said initial value for a start basic fuel injection amount and an after-start increment coefficient when said cranking is started after said predetermined elapsed time;

selecting means for choosing an appropriate map according to a difference between coolant temperatures at a precedent engine stop and at a present engine start;

retrieving means for reading said map corresponding to said coolant temperature;

deciding means for determining a start fuel injection amount by correcting said initial value for said start basic fuel injection amount and by using other start correction coefficients during engine cranking; and correcting means for determining said amount of fuel by correcting the fuel injection amount on the basis of engine operating conditions with said increment coefficient after said engine start so as to easily restart said engine at any conditions by supplying an optimum amount of fuel.

2. A method for controlling an amount of fuel for an internal combustion engine having, a fuel injector, an idle speed control valve for controlling idle speed, an ECU to control an air-fuel mixture and ignition timing of said engine, a starter motor, a starter switch for switching said starter motor on and off, a self-shut relay for supplying said ECU with electric power for a predetermined time period, an ignition key switch, a read memory switch for diagnosing said engine, an intake air sensor for measuring intake air amount, a throttle sensor for detecting a throttle opening angle, an idle switch for detecting an idling condition of said engine, a coolant temperature sensor for detecting engine temperature, an oxygen ($O_2$) sensor for detecting residual oxygen concentration in exhaust gases, a crank angle sensor for detecting engine speed, a cam angle sensor for discriminating a cylinder number, and an igniter for producing an ignition voltage and for distributing an ignition current to a spark plug, the method comprising the steps of:

judging whether or not cranking is started within a predetermined elapsed time from a precedent engine stop;

determining an initial value for a start basic fuel injection amount and an after-start increment coefficient according to predetermined data when said cranking is started within said predetermined time;

determining said initial value for a start basic fuel injection amount and an after-start increment coefficient when said cranking is started after said predetermined elapsed time;

choosing an appropriate map according to a difference between coolant temperatures at a precedent engine stop and at a present engine start;

reading said map corresponding to said coolant temperature;

deciding a start fuel injection amount by correcting said initial value for said start basic fuel injection amount and by using other start correction coefficients during engine cranking; and, correcting said amount of fuel by correcting the fuel injection amount on the basis of engine operating conditions with said increment coefficient after said engine start so as to easily restart said engine at any conditions by supplying an optimum amount of fuel.

* * * * *